US010935229B2

(12) United States Patent
Gauthier

(10) Patent No.: US 10,935,229 B2
(45) Date of Patent: Mar. 2, 2021

(54) ADJUSTABLE LIGHTING FIXTURE FOR DECORATIVE LIGHT

(71) Applicant: Lumenpulse Group Inc., Longueuil (CA)

(72) Inventor: Felix Gauthier, Montreal (CA)

(73) Assignee: LUMENPULSE GROUP INC., Quebec (CA)

( * ) Notice: Subject to any disclaimer, the term of this patent is extended or adjusted under 35 U.S.C. 154(b) by 135 days.

(21) Appl. No.: 16/151,834

(22) Filed: Oct. 4, 2018

(65) Prior Publication Data

US 2020/0109850 A1 Apr. 9, 2020

(51) Int. Cl.

| | |
|---|---|
| ***F21V 31/00*** | (2006.01) |
| ***F21V 15/01*** | (2006.01) |
| ***F21V 29/76*** | (2015.01) |
| ***F21V 17/18*** | (2006.01) |
| ***F21V 23/02*** | (2006.01) |
| ***F21V 19/00*** | (2006.01) |
| ***F21V 29/503*** | (2015.01) |
| ***F21Y 115/10*** | (2016.01) |
| ***F21W 121/00*** | (2006.01) |

(52) U.S. Cl.

CPC ..... *F21V 31/005* (2013.01); *F21V 15/01* (2013.01); *F21V 17/18* (2013.01); *F21V 19/0055* (2013.01); *F21V 23/02* (2013.01); *F21V 29/503* (2015.01); *F21V 29/76* (2015.01); *F21W 2121/00* (2013.01); *F21Y 2115/10* (2016.08)

(58) Field of Classification Search

CPC ..... F21V 21/14; F21V 21/30; F21V 31/005
See application file for complete search history.

(56) References Cited

U.S. PATENT DOCUMENTS

| | | | | |
|---|---|---|---|---|
| D421,316 | S | 2/2000 | Fiorato | |
| 7,458,330 | B2 | 12/2008 | MacDonald et al. | |
| D682,458 | S | 5/2013 | Calvin et al. | |
| D726,949 | S | 4/2015 | Redfern | |
| D777,967 | S | 1/2017 | Redfern | |
| D779,100 | S | 2/2017 | Redfern | |
| D786,472 | S | 5/2017 | Redfern | |
| D850,696 | S | 6/2019 | Zhu | |
| D887,065 | S | 6/2020 | Speier | |
| 2007/0268705 | A1 | 11/2007 | Von Preyss | |
| 2008/0137347 | A1* | 6/2008 | Trott | F21V 17/02 362/311.06 |
| 2010/0061097 | A1 | 3/2010 | Krogman | |

(Continued)

OTHER PUBLICATIONS

Lumenpulse® Lumenbeam® Inground brochure dated Jul. 2020.

*Primary Examiner* — Diane I Lee
*Assistant Examiner* — Zachary J Snyder
(74) *Attorney, Agent, or Firm* — Burns & Levinson, LLP; Joseph M. Maraia; Steven M. Mills

(57) ABSTRACT

A lighting fixture includes, a lower portion including a plurality of lighting elements and an upper portion. An exterior protective casing is configured to house the upper and lower portions to protect them from an outside environment. An accordion gasket connects the lower portion and the upper portion. The accordion gasket is configured to maintain a seal between the lower portion and the upper portion when the lower portion is tilted with respect to the upper portion and when the lower portion and the upper portion are rotated with respect to the exterior protective casing.

12 Claims, 10 Drawing Sheets

(56) References Cited

U.S. PATENT DOCUMENTS

| | | | | |
|---|---|---|---|---|
| 2013/0077305 | A1* | 3/2013 | Krogman | F21V 21/14<br>362/235 |
| 2014/0313744 | A1* | 10/2014 | Collias | F21V 15/012<br>362/311.02 |
| 2016/0327258 | A1 | 11/2016 | Sloan | |
| 2016/0334079 | A1 | 11/2016 | Donnini | |
| 2016/0377280 | A1 | 12/2016 | Acampora et al. | |
| 2018/0094776 | A1 | 4/2018 | She | |

* cited by examiner

ADJUSTABLE LIGHTING FIXTURE FOR DECORATIVE LIGHT

FIELD OF THE TECHNOLOGY

The subject disclosure relates to lighting fixtures, and particularly to lighting fixtures configured for decorative lighting.

BACKGROUND

Lighting fixtures can be installed in various locations to provide illumination for visibility and/or decoration. For example, lighting fixtures can be embedded in a floor or other surface and configured to project light onto a desired surface for illumination. The illuminated surface can be a wall (wall wash), an archway, a statue, or some other structural or decorative feature, for example. The illuminated surface can be completely illuminated, or partially illuminated pursuant to a design choice by the user. As such, depending on the desired application, different numbers of lighting fixtures can be used, as well as different widths, heights, intensities, colors, etc., of illumination.

Unfortunately, obtaining a specific desired illumination usually requires the lighting fixtures be configured prior to installation being completed. Adjusting typical light fixtures during, or after installation, can lead to numerous problems such as a poorly sealed fixture. This can leave parts of the lighting fixture exposed to the elements. Additionally, adjustments can lead to an undesired shifting of parts, resulting in poor thermal transfer between key electronic components and a heat sink. These problems can result in poor performance of the lighting fixtures and/or significant cost to the user.

SUMMARY

In light of the needs described above, in at least one aspect, the subject technology relates to a lighting fixture that is easily adjustable during and after installation, and can be adjusted without exposing the interior workings to the outside environment.

BRIEF DESCRIPTION OF THE DRAWINGS

So that those having ordinary skill in the art to which the disclosed system pertains will more readily understand how to make and use the same, reference may be had to the following drawings.

DETAILED DESCRIPTION

Figures 1A, 1B:
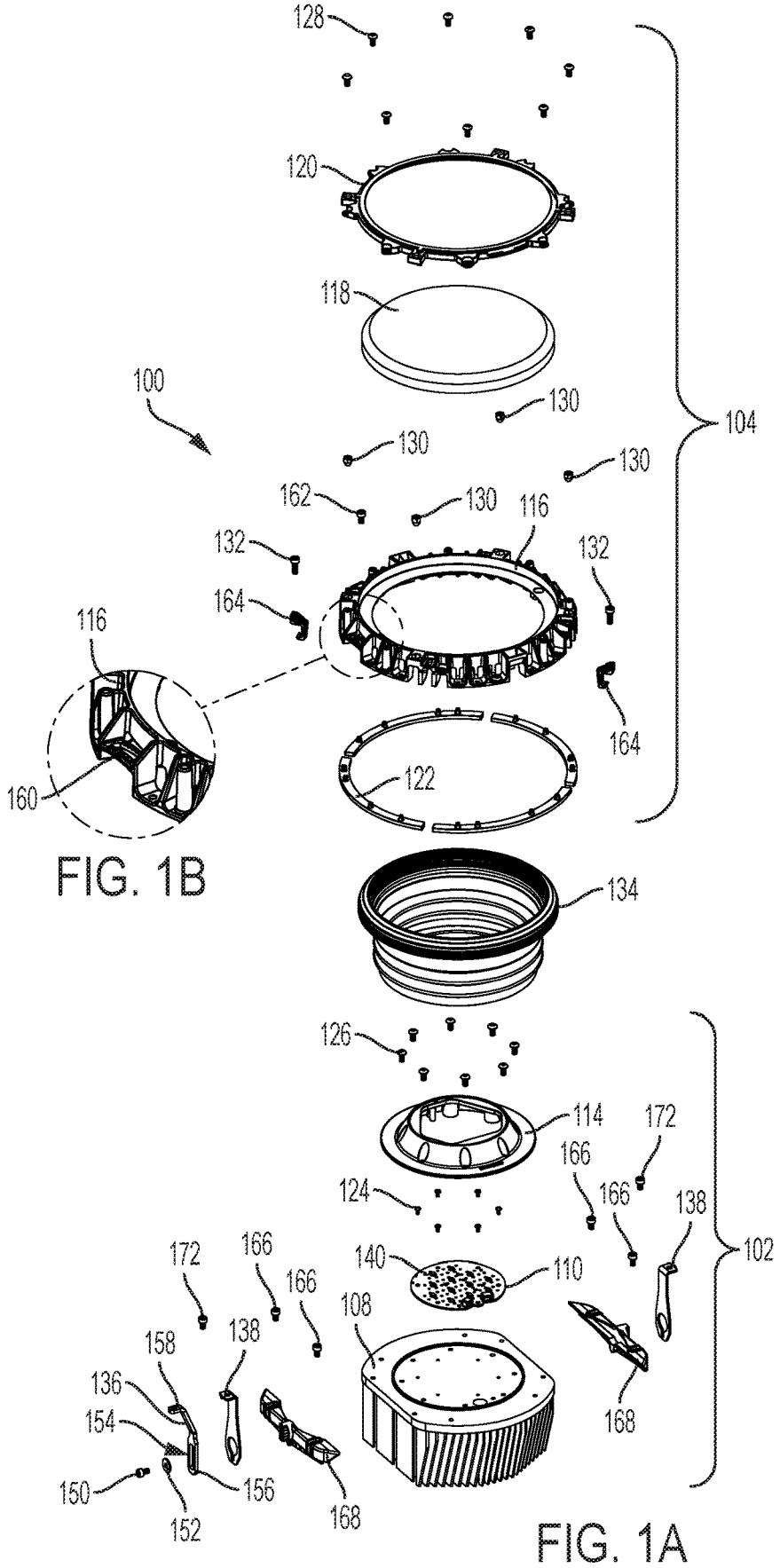
FIG. 1A is an exploded view of a lighting fixture in accordance with the subject technology.
FIG. 1B is a zoomed in view of the outer housing lip of the lighting fixture of FIG. 1A

The subject technology overcomes many of the prior art problems associated with lighting fixtures. In brief summary, the subject technology provides a lighting fixture which allows for easy rotation and tilt to adjust the angle and shape visible light on a surface. The advantages, and other features of the systems and methods disclosed herein, will become more readily apparent to those having ordinary skill in the art from the following detailed description of certain preferred embodiments taken in conjunction with the drawings which set forth representative embodiments of the present invention. Like reference numerals are used herein to denote like parts. Further, words denoting orientation such as "upper", "lower", "distal", and "proximate" are merely used to help describe the location of components with respect to one another. For example, an "upper" surface of a part is merely meant to describe a surface that is separate from the "lower" surface of that same part. No words denoting orientation are used to describe an absolute orientation (i.e. where an "upper" part must always be on top).

Figure 2:
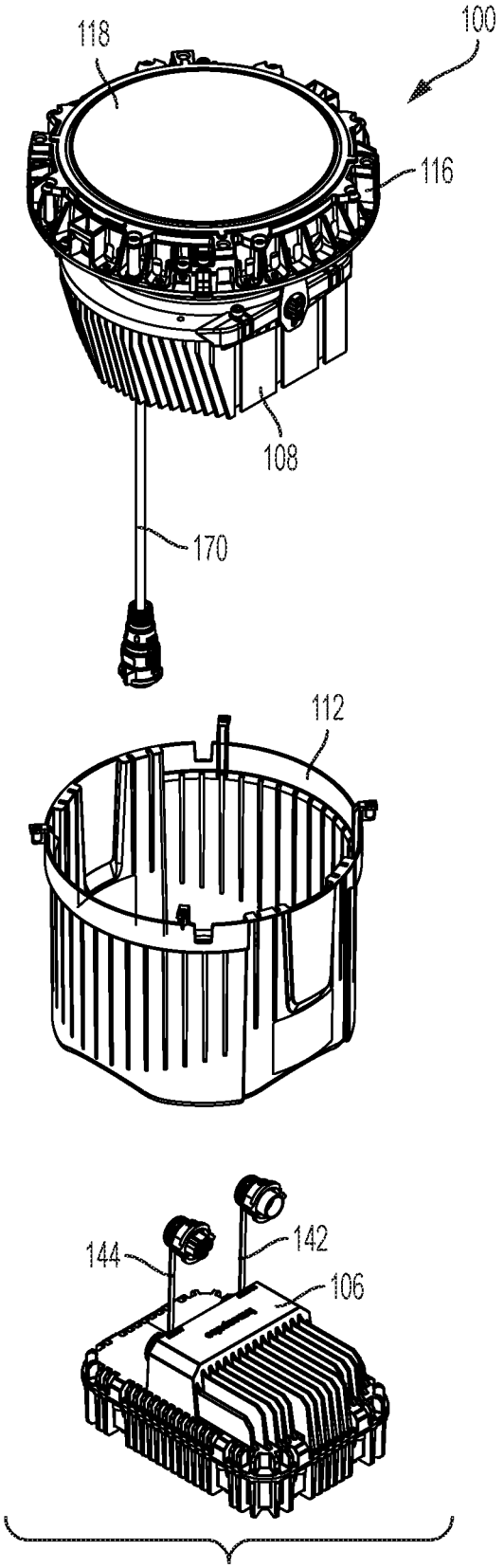
FIG. 2 is a partially exploded view of a lighting fixture in accordance with the subject technology.
Figure 3:
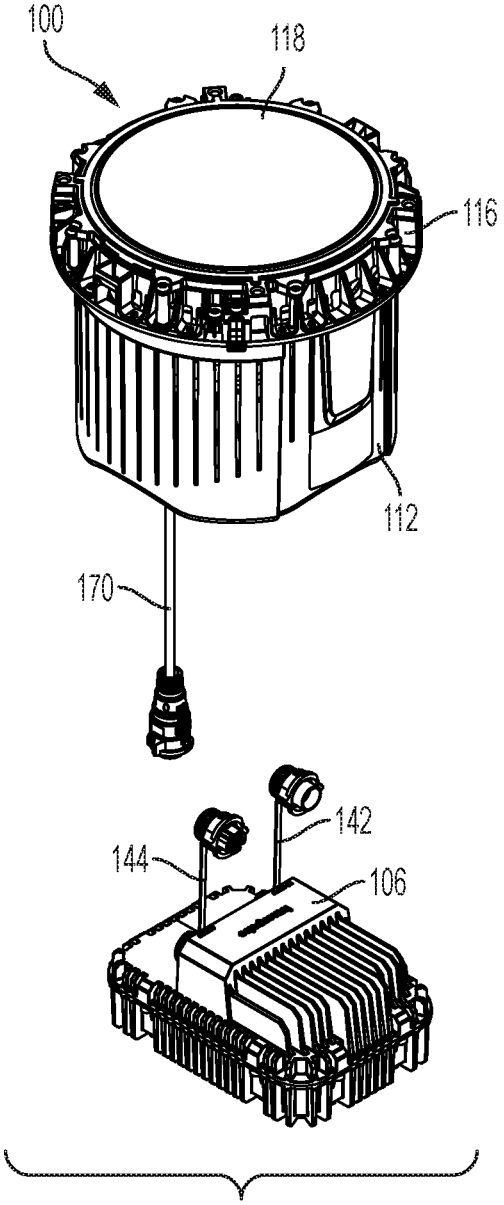
FIG. 3 is a partially exploded view of a lighting fixture in accordance with the subject technology.

Referring now to FIGS. 1A-3, exploded views of a lighting fixture 100 in accordance with the subject technology are shown. In particular, FIG. 1A shows an exploded view of the components of a lighting fixture 100 in accordance with the subject technology. FIGS. 2-3 show partially exploded, partially assembled views of a lighting fixture 100 in accordance with the subject technology.

For ease of understanding, the lighting fixture 100 can be described as having two different sections; a lower portion 102 and an upper portion 104. The lower portion 102 includes a heat sink 108 and an LED board 110 housed in an air deflector 112, as well as a sealing ring 114. A power box 106 is connected to the lower portion 102. Screws 124 fix the LED board 110 to a surface of the heat sink 108 while screws 126 fix the sealing ring 114 to the heatsink 108. The upper portion 104 includes an upper housing 116, a lens 118, a sealing trim 120, and a shim 122. Screws 128 fix the sealing trim 120 (which acts as a support structure) to the upper housing 116, sandwiching the lens 118 in between. Nuts 130 are provided to allow for the attachment of other hardware, as desired. The upper portion 104 and the lower portion 102 are connected by mechanical components and sealed together by an accordion gasket 134. In the embodiment shown, a locking bracket 136 and mounting brackets 138 mechanically connect the upper portion 104 and the lower portion 102. Pivot screws 166 attach pivot frames 168 to the heat sink 108. The lower ends of the mounting brackets 138 are then rotatably coupled to the pivot frames 168, and thus, the heat sink 108. This can be accomplished by engaging circular openings in the mounting brackets 138 with protrusions in the pivot frames 168. Screws 172 immovably couple the mounting brackets 138 to the upper housing 116 to prevent further respective movement of the parts of the lighting fixture 100, as discussed in more detail below. In this way, the mounting brackets 138 connect the upper and lower portions 104, 102, but the rotatable connection to the lower portion 102 allows the lower portion 102 to tilt with respect to the upper portion 104. When assembled, the lighting fixture 100 is designed to give off light and can be used to illuminate a surface.

To that end, the lighting fixture 100 includes a plurality of lighting elements 140 which produce the light for the lighting fixture 100. In the example shown, the lighting elements 140 are LEDs and are mounted on an LED board 110, but other types of lighting elements can also be used. The LED board 110 includes focusing optics (not distinctly shown) which focus light coming from the lighting elements 140. The LED board 110 is connected to a power box 106 which powers the lighting elements 140. The power box 106 can be connected to an external power source, like the electrical grid, via an attached power chord 142. In some cases, the power box 106 can also convert power from an AC power source, like the electrical grid, to DC power before providing power to the lighting elements 140. Power can be transmitted from the power box 106 to the LED board 110 via internal power cables 144, 170. The heat sink 108 is thermally coupled to the LED board 110 to disperse heat and can be positioned between the LED board 110 and the power box 106.

Light emitted from the lighting elements 140 is directed to the lens 118 in the upper portion 104 of the lighting fixture 100. In general, the lens 118 can include one or more panes of glass which allow light from the lighting elements 140 to pass through, into the surrounding environment. The sealing trim 120 is seated on top and effectively holds the lens 118 in place.

The accordion gasket 134 helps the lighting fixture 100 maintain a proper seal even when adjustments are made. When fully assembled, the accordion gasket 134 provides a hermetic seal between the upper and lower portion 104, 102, while still allowing the upper and lower portion 104, 102 to move. This effectively creates a hermetic chamber between the lens 118, upper housing 116, accordion gasket 134, and heat sink 108 that protects the LED board 110 even as the upper and lower portion 104, 102 are rotated, or the upper portion 104 is tilted with respect to the lower portion 102. The accordion gasket 134 also ensures pressure equalization and minimal condensation, allows the lighting elements 140 to function effectively. Additionally, the accordance gasket 134 helps keep the hermetic chamber sealed while also not interfering with the thermal contact between the LED board 110 and the heat sink 108.

Figure 4:
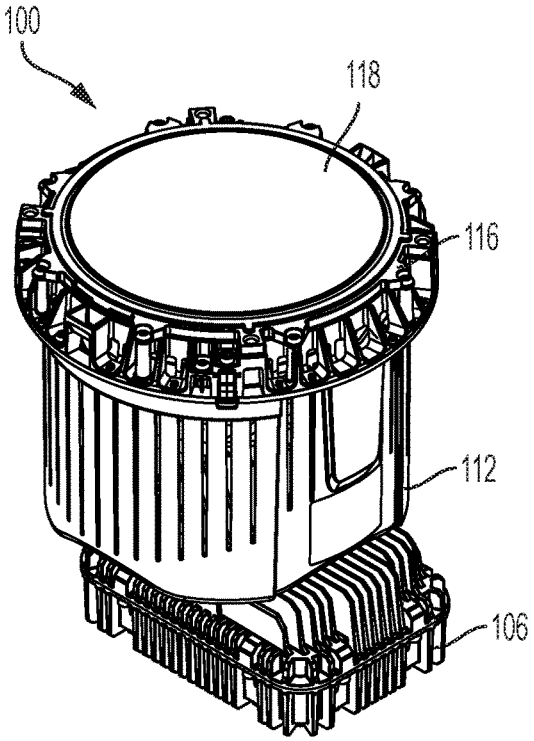
FIG. 4 is a perspective view of a lighting fixture in accordance with the subject technology.
Figure 5:
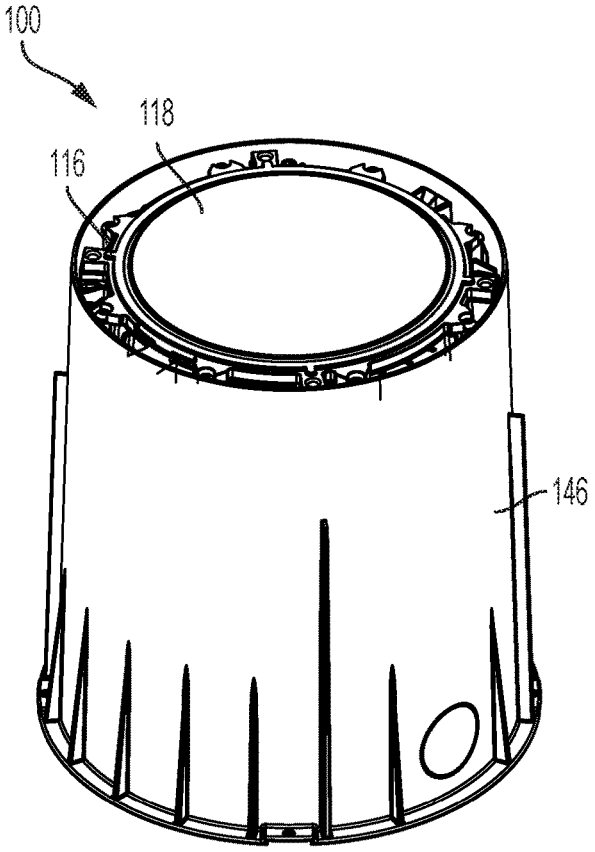
FIG. 5 is a perspective view of a lighting fixture in accordance with the subject technology.

Referring now to FIG. 4, a perspective view of the assembled lighting fixture 100 is shown. The air deflector 112 is directly connected to the upper housing 116 and encases the heat sink 108 to help protect the internal components. Further, the air deflector 112 defines an air gap around the heat sink 108 and includes multiple openings to facilitate air flow around the heat sink 108 and promote proper functioning. The air deflector 112 can be positioned above the power box 106 within a protective casing 146. The protective casing 146 can be included to protect the other components of the lighting fixture 100, as seen in FIG. 5. While the protective casing 146 does not provide a hermetic seal, it does protect the lighting fixture 100 from the surface within which the lighting fixture is installed 100.

Figure 6:
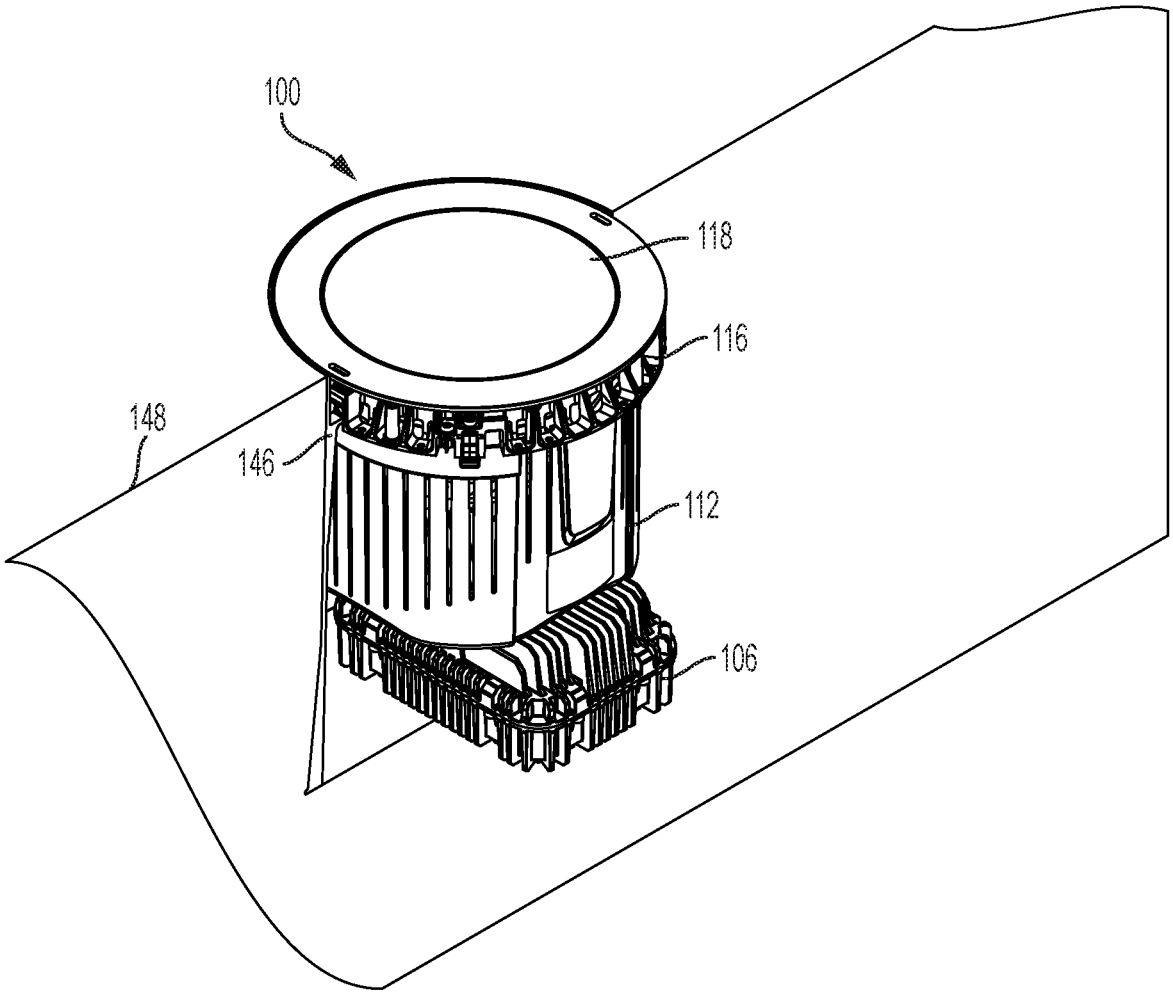
FIG. 6 is a partially cut away cross sectional view of a ground surface with an installed lighting fixture, in accordance with the subject technology.

Referring now to FIG. 6, a partial cross section of a surface 148 showing an installed lighting fixture 100 is shown. The protective casing 146 is also shown in cross section so that the other components of the lighting fixture 100 can be seen. The surface 148 is not limited to a particular kind and can be a ground surface such as dirt, sand, gravel, asphalt, or concrete, a building wall, or any other surface suitable to support a lighting fixture. Notably, the lighting fixture 100 can first be placed in the hole in the surface 148, and adjustments can then be made before the lighting fixture 100 is permanently set. Once set, the lighting fixture 100 can then be powered on to wash a proximate wall (not shown) with light.

Figure 7A:
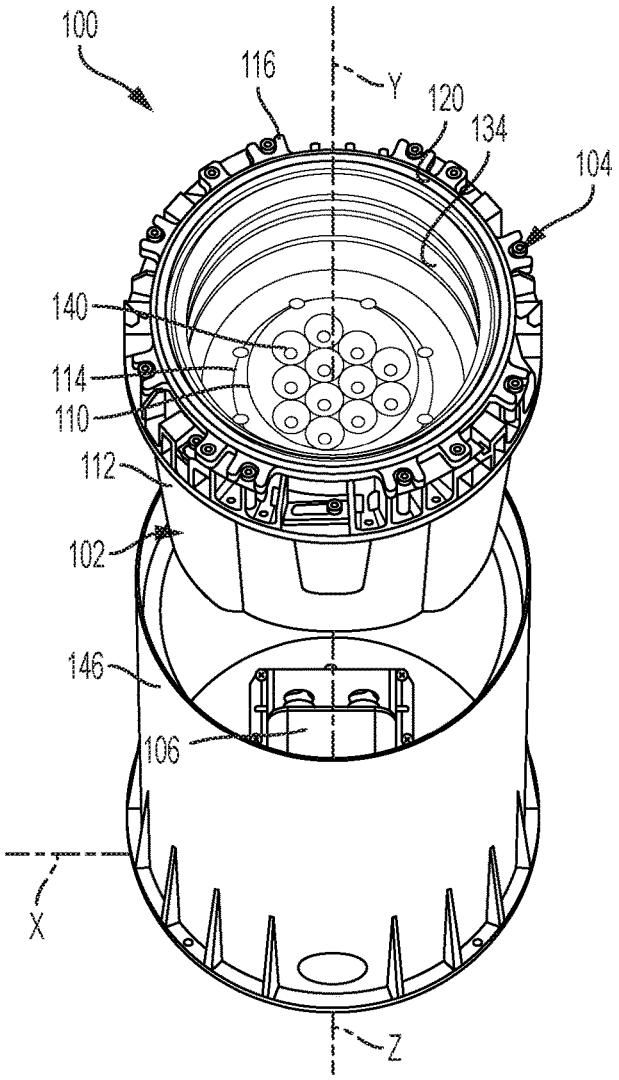
FIG. 7A is a perspective view showing the assembly of lighting fixture in accordance with the subject technology.
Figure 7B:
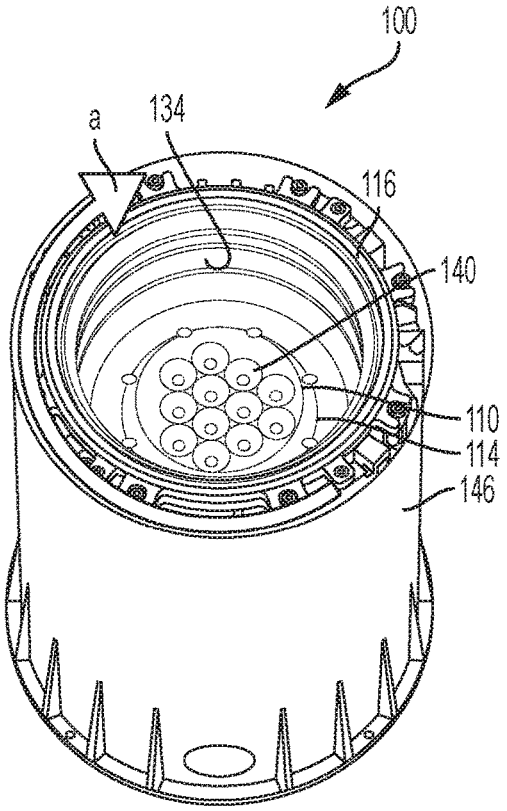
FIG. 7B is a perspective view showing a lighting fixture configured to rotate in accordance with the subject technology.
Figure 7C:
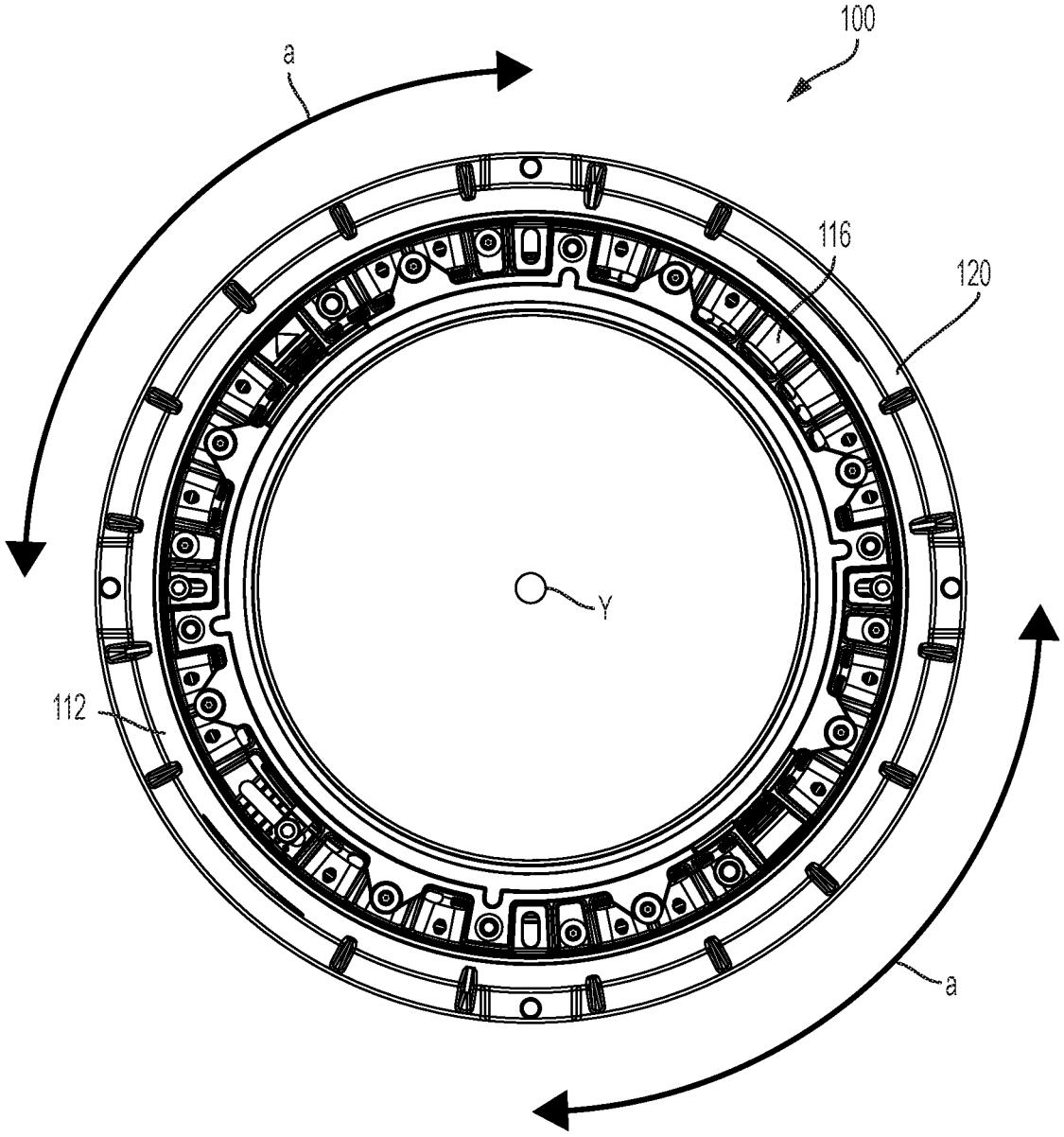
FIG. 7C is a top view showing a lighting fixture configured to rotate in accordance with the subject technology.

Referring now to FIGS. 7A-7C, the lighting fixture 100 allows for easy adjustments during installation to be made. In particular, FIGS. 7A-7C depict how the rotation of the lighting fixture 100 after it is set in the ground. The upper portion 104 and the lower portion 102 are coupled with respect to rotation and can be rotated together after the lighting fixture 100 is set in the surface.

As previously mentioned, during installation, the lighting fixture 100 can be protected by a protective casing 146. As such, the upper and lower portions 104, 102 can be placed within the protective casing 146, the lower portion 102 sitting above the power box 106. In this position, the protective casing 146 also defines an air gap around the heat sink 108 to facilitate air flow around the heat sink 108 and facilitate proper functioning. The protective casing 146 includes a lip 174 (See FIGS. 11A-11C) upon which the upper housing 116 rests. The mounting brackets 138 couple the upper portion 104 and the lower portion 102 causing them to rotate together as the upper housing 116 is rotated over the lip 174 of the protective casing 146. Thus, prior to the protective casing 146 being fastened to the upper housing 116, as described in more detail below, the upper portion 104 and lower portion 102 are rotatable together, with respect to the protective casing 146 and the power box 106 around a vertical axis (i.e. the y-axis, vertical when the lighting fixture 100 is placed vertically within a surface that runs parallel to ground). Therefore the user can rotate the upper portion 104 and lower portion 102 with respect to protective casing 146, along rotation arrow "a" to achieve any amount of rotation (i.e. −180 to 180 degrees, for a total of 360 degrees of rotation). Importantly, rotation of the upper portion 104 and lower portion 102 changes the angle and direction of the light being emitted out of the lighting fixture 100. This in turn changes how the relevant surface is illuminated based on the projected light, changing the corresponding shape and/or shape of light on the surface. In this way, the user can easily adjust the illumination to correspond to a desired design.

Figure 9:
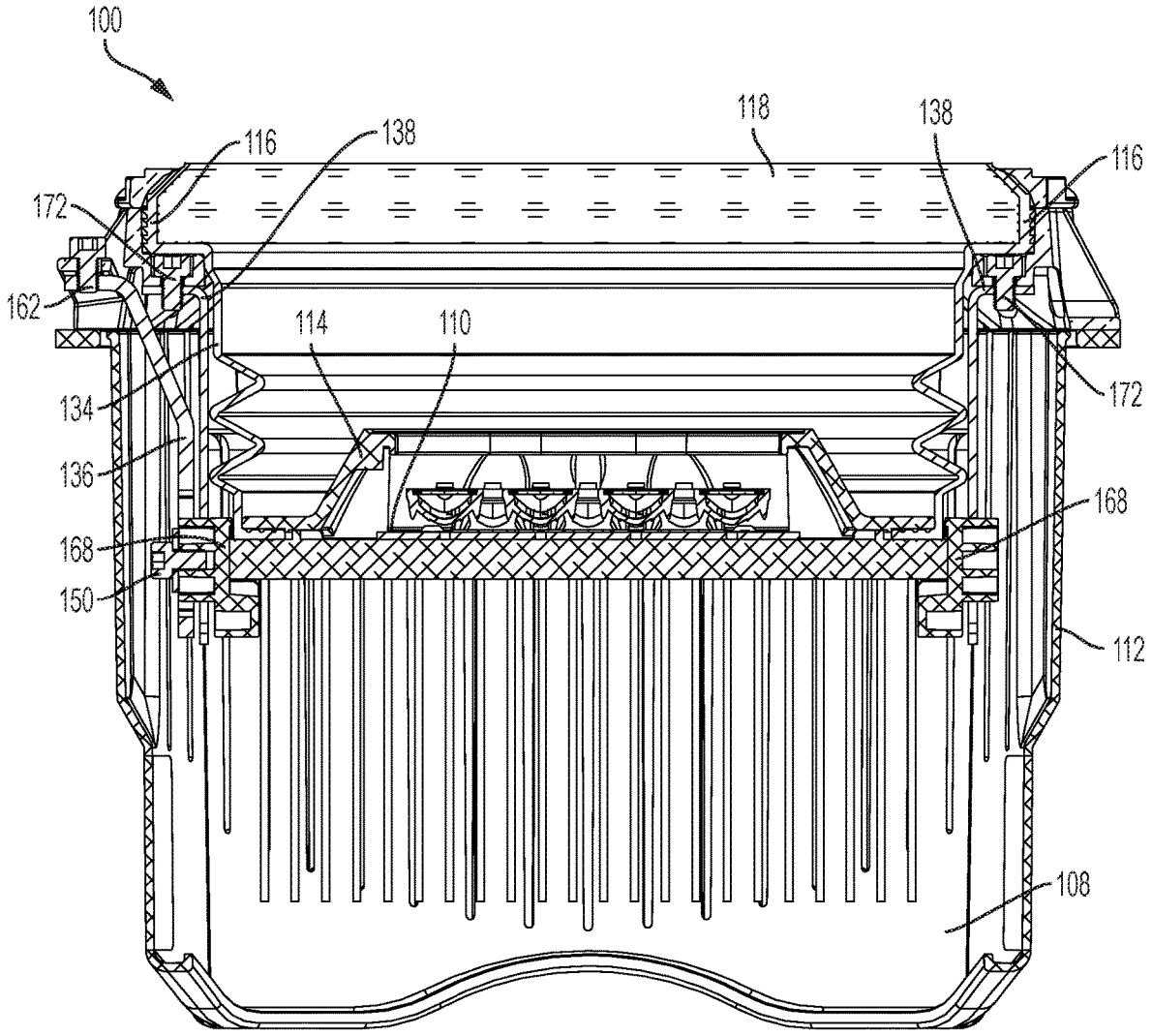
FIG. 9 is a cross sectional front view of a lighting fixture in accordance with the subject technology.
Figure 10:
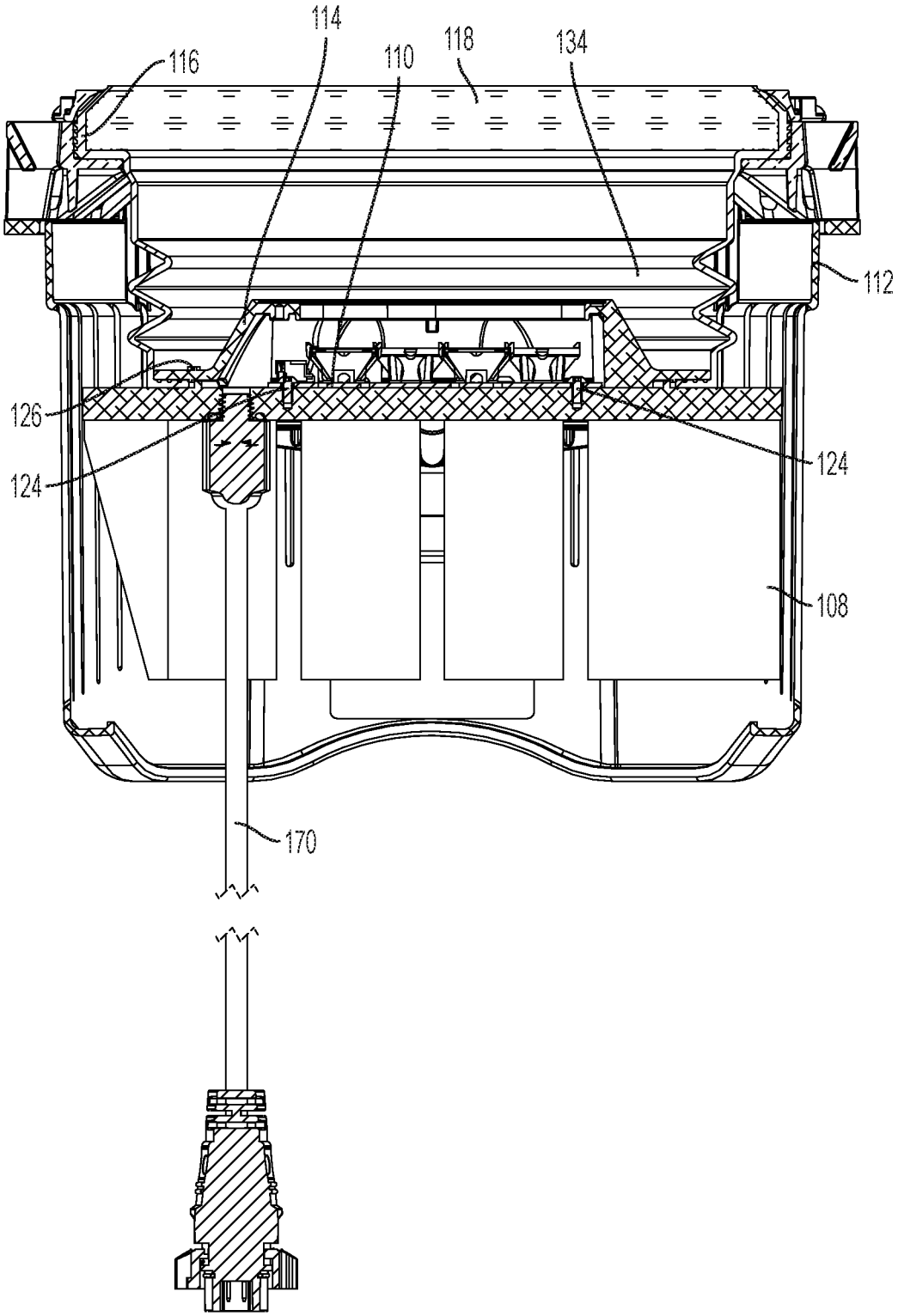
FIG. 10 is a cross sectional side view of a lighting fixture in accordance with the subject technology.

Referring now to FIGS. 1A-1B, the locking bracket 136 is coupled to the lower portion 102 (e.g. as seen in FIG. 9) by a screw 150 and washer 152 which are threaded through a loop 154 in a first end 156 of the locking bracket 136. The loop 154 shown is oblong to allow the locking bracket 136 to be fixed to the heat sink 108 via an extension from the pivot frame 168 at various locations along the first end 156. The screw 150 prevents the locking bracket 136 from disengaging from the pivot frame 168. The second end 158 of the locking bracket 136 rests on a curved lip 160 proximate to the perimeter of the upper housing 116. The curved lip 160 is curved such that the second end 158 of the locking bracket 136 can easily slide across the curved lip 160 to tilt the upper portion 104 with respect to the lower portion 102. When a desired degree of tilt is reached, as discussed in more detail below, tilt locking screw 162 can be inserted into the second end 158 of the locking bracket 136 and tightened to fasten the locking bracket 136 against the lip 160. The tilt locking screw 162 can include a hex head to allow for easy tightening. Once the tilt locking screw 162 is tightened, the upper portion 104 is fixed in place by the locking bracket 136 such that the upper portion 104 will remain at that tilt position with respect to the lower portion 102. Therefore the user can selectively secure the second end 158 to the upper housing 116 by tightening the screw 162.

Figure 8D:
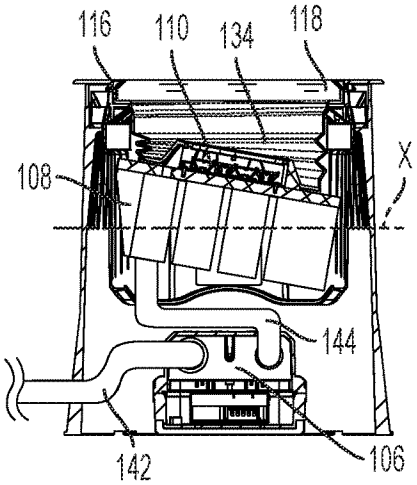
FIGS. 8B-8D are cross sectional views of the lighting fixture of FIG. 8A showing varying degrees of tilt in accordance with the subject technology.
Figure 8C:
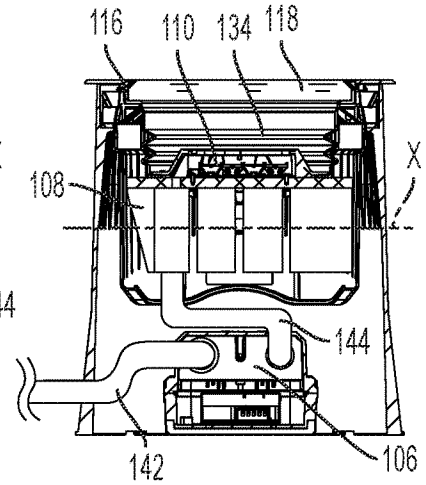
Figure 8B:
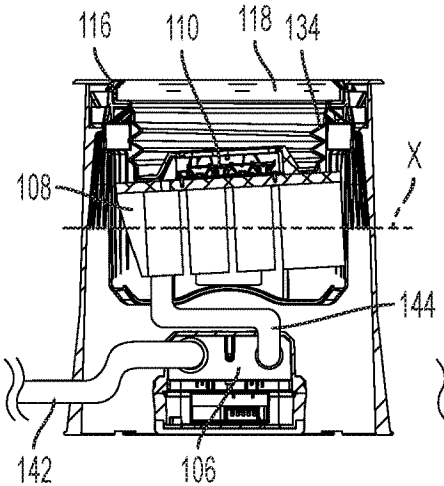
Figure 8A:
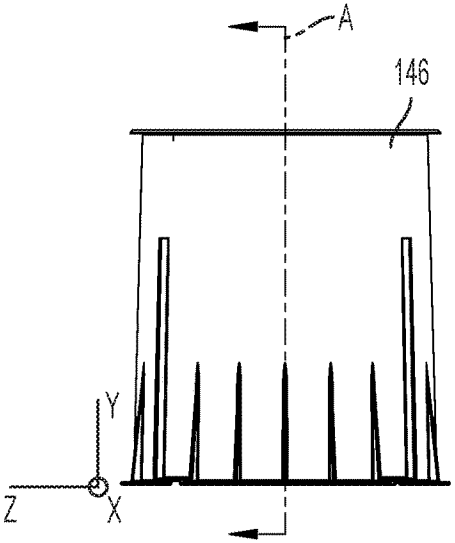
FIG. 8A is a front view of a lighting fixture in accordance with the subject technology.

Referring now to FIGS. 8A-8D, the curved lip 160 allows the upper portion 104 to tilt with respect to the lower portion 102, in a different direction (e.g. changing the orientation with respect to the x-y plane) prior to the tilt locking screw 162 being tightened. FIG. 8B shows the LED board 110 of the lower portion 102 being tilted roughly −3 degrees about the x-y plane with respect to the components in the upper portion 104 (e.g. the upper housing 116, lens 118, etc.). FIG. 8C shows the LED board 110, and other components of the lower portion 102, at a neutral position with respect to the components of the upper portion 104. FIG. 8D shows the LED board 110 at a tilt about the x-y plane of 15 degrees with respect to the upper portion 104. In some cases, it has been found desirable to configure components of the lighting fixture 110 to allow for a tilt of substantially (i.e. +/−10 percent) between −3 and 15 degrees with respect to the x-y plane. For example, the lip 160 of the upper housing 116 can be designed with a curvature that coupled to the locking bracket 136 to allow for tilting between −3 degrees to 15 degrees.

Referring now to FIGS. 9-11C, cross sectional views of a fully assembled lighting fixture 100 in accordance with the subject technology are shown. For simplicity, the lighting fixture 100 is shown in a neutral, non-tilted position. Screws 172 connect the mounting brackets 138 to the upper portion 104 while the lower end of the mounting brackets 138 is coupled to the lower portion 102 by pivot frames 168. The locking bracket 136 is attached to the lower portion 102 by screw 150 and to the upper portion 104 by screw 162. The sealing ring 114 presses down on the base of the accordion gasket 134, sealing the accordion gasket 134 to the heat sink 108 to help maintain the hermetically sealed inner cavity. When the sealing ring 114 is securely in place, it also acts as an aesthetic shield for the lighting elements 140.

Figure 11C:
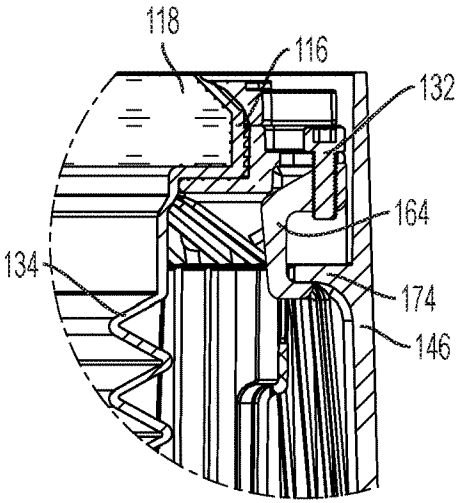
FIGS. 11B-11C are zoomed in views showing a screw being tightened within a fastening jaw of the lighting fixture of FIG. 11A.
Figure 11B:
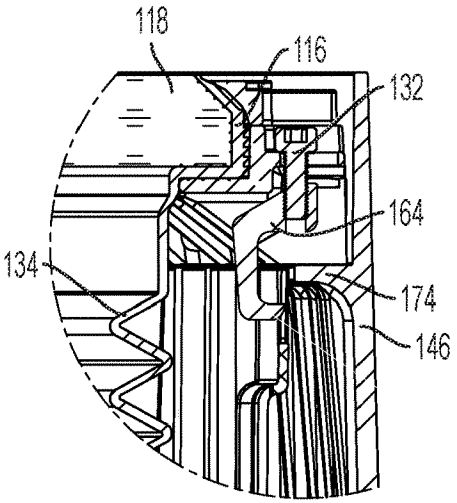
Figure 11A:
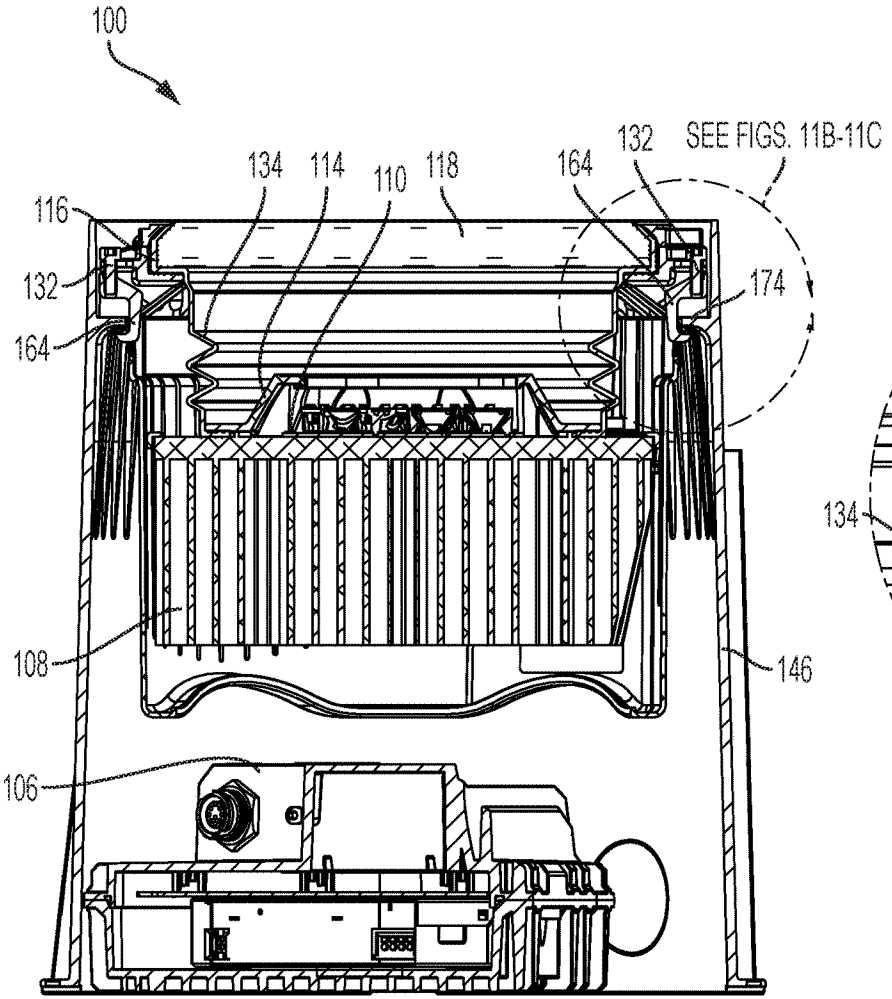
FIG. 11A is a cross sectional front view of a lighting fixture in accordance with the subject technology.

As best seen in FIG. 11A, protective casing 146 is attached to the upper housing 116 by screws 132 and fasteners 164. The screws 132 are threaded to engage with openings at the upper end of each fastener 164. Before tightening the screws 132, as seen in FIGS. 11A-B, lower ends of the fasteners 164 can be placed against lips 174 of the protective casing 146. As the screws 132 are tightened, the fasteners 164 engage the lips 174 to pull the other components of the lighting fixture 100 up with respect to the protective casing 146. When the screws 132 are fully tightened, the lighting fixture 100 is locked in place as seen in FIG. 11C. This prevents further rotation of the upper portion 104 and lower portion 102 with respect to the protective casing 146.

All orientations and arrangements of the components shown herein are used by way of example only. Further, it will be appreciated by those of ordinary skill in the pertinent art that the functions of several elements may, in alternative embodiments, be carried out by fewer elements or a single element. Similarly, in some embodiments, any functional element may perform fewer, or different, operations than those described with respect to the illustrated embodiment. Also, functional elements (e.g. power cords, screws, and the like) shown as distinct for purposes of illustration may be incorporated within other functional elements in a particular implementation.

While the subject technology has been described with respect to preferred embodiments, those skilled in the art will readily appreciate that various changes and/or modifications can be made to the subject technology without departing from the spirit or scope of the subject technology. For example, each claim may depend from any or all claims in a multiple dependent manner even though such has not been originally claimed.

What is claimed is:

1. A lighting fixture comprising:
a lower portion including a plurality of lighting elements;
an upper portion;
an exterior protective casing configured to house the upper and lower portions to protect them from an outside environment;
an accordion gasket connecting the lower portion and the upper portion, the accordion gasket configured to maintain a seal between the lower portion and the upper portion when the lower portion is tilted with respect to the upper portion; and the lower portion and the upper portion are rotated with respect to the exterior protective casing; and
a locking bracket configured to be securely coupled to the lower portion on a first end of the locking bracket and slidably coupled to a lip of the upper housing on a second end of the locking bracket to allow for tilting of the lower portion with respect to the upper portion, the first end being further configured to be selectively secured to the upper housing to prevent tilting of the lower portion with respect to the upper portion.

2. The lighting fixture of claim 1, wherein:
the lower portion includes a heat sink;
the upper portion includes an upper housing; and
the exterior protective casing defines an air gap around the heat sink to promote air flow around the heat sink.

3. The lighting fixture of claim 1, further comprising an air deflector connected to the upper housing and encasing the heat sink, the air deflector defining an air gap around the heat sink to facilitate air flow around the heat sink.

4. The lighting fixture of claim 3, further comprising two mounting brackets configured to be rotatably coupled to the heat sink on a first end of each locking bracket via pivot frames, the mounting brackets coupling the upper portion to the lower portion to prevent rotation between the upper portion and the lower portion.

5. The lighting fixture of claim 4, wherein the lower portion is configured to tilt, with respect to the upper portion, between −3 degrees and 15 degrees.

6. The lighting fixture of claim 5, wherein the upper portion and lower portion are configured to rotate, with respect to the exterior protective casing, between −180 and 180 degrees.

7. The lighting fixture of claim 6, wherein the plurality of lighting elements are LED lights arranged on an LED board.

8. The lighting fixture of claim 7, wherein the LED board is mounted directly on the heat sink.

9. The lighting fixture of claim 8, further comprising a power box connected to the LED board.

10. The lighting fixture of claim 9, wherein the lower portion includes a sealing ring, a portion of the gasket and the LED board being positioned between the sealing ring and the heat sink, the sealing ring being fastened to the heat sink to hold the portion of the gasket against the heat sink.

11. The lighting fixture of claim 1, wherein the upper portion includes a lens.

12. The lighting fixture of claim 2, further comprising at least one fastener each configured to selectively engage a lip of the exterior protective casing on a first end and the upper housing on a second end to prevent rotation of the first and second portions with respect to the protective casing.

* * * * *